United States Patent [19]

Köhnen et al.

[11] Patent Number: 4,574,713

[45] Date of Patent: Mar. 11, 1986

[54] PIN FOR HOLDING AND/OR COOLING OF CERAMIC COATINGS IN HOT REACTION CHAMBERS, AND METHOD OF MANUFACTURING THE SAME

[75] Inventors: Klaus Köhnen, Mühlheim/Ruhr; Norbert Ullrich; Reinhard Müller, both of Essen, all of Fed. Rep. of Germany

[73] Assignee: Krupp-Koppers GmbH, Essen, Fed. Rep. of Germany

[21] Appl. No.: 731,484

[22] Filed: May 7, 1985

[30] Foreign Application Priority Data

Jun. 28, 1984 [DE] Fed. Rep. of Germany ..... 3423807

[51] Int. Cl.[4] ..... F23M 5/00

[52] U.S. Cl. ..... 110/336; 52/504

[58] Field of Search ..... 110/336; 52/474, 761, 52/765, 766, 506, 404; 29/460, 527.2

[56] References Cited

U.S. PATENT DOCUMENTS 3,652,251 3/1972 Brichard ..... 110/336 X 3,771,467 11/1973 Sweet ..... 110/336

*Primary Examiner*—Edward G. Favors

*Attorney, Agent, or Firm*—Michael J. Striker

[57] ABSTRACT

A pin for holding and/or cooling ceramic coating in hot reaction chambers is composed of a pin shaft and a pin cap which are connected with one another by a diffusion welding forming therebetween a homogeneous material connection possessing a high strength and high heat conductive properties.

2 Claims, 1 Drawing Figure

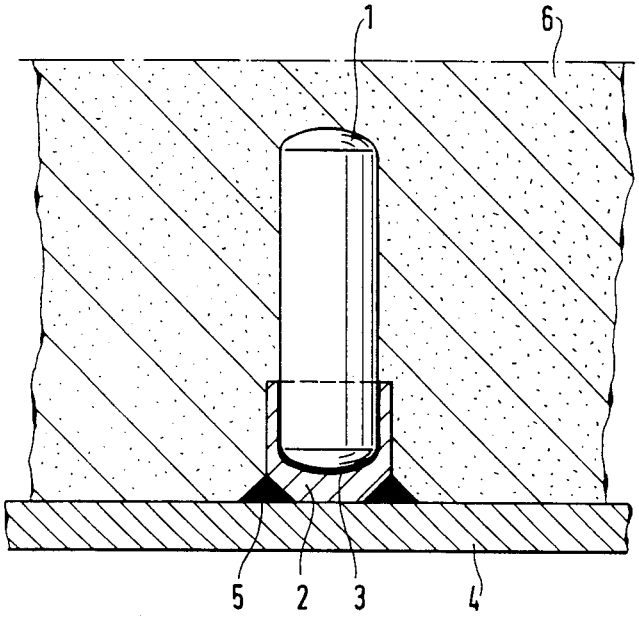
1
6
5
2
3
4

PIN FOR HOLDING AND/OR COOLING OF CERAMIC COATINGS IN HOT REACTION CHAMBERS, AND METHOD OF MANUFACTURING THE SAME

BACKGROUND OF THE INVENTION

The present invention relates to a pin for holding and/or cooling of ceramic coatings in hot reaction chambers, particularly to a pin which is composed of two components. The invention also relates to a method of manufacturing of such pin.

A pin for holding and/or cooling the ceramic coating in hot reaction chambers and composed of two components is disclosed in U.S. patent application Ser. No. 572,922. More particularly, this pin includes a pin shaft composed of a material which under the respective reaction conditions in the hot reaction chamber is temperature-, corrosion-, erosion- and oxidation-resistant. It further includes a pin cap which is composed, to the contrary, of a material corresponding to the material of the wall of the hot reaction chamber. The pin shaft is fitted in the pin cap and connected with the latter in a firm and heat-conductive manner.

In hot reaction chambers, such as for example in firing chambers or reaction chambers of coal gasifiers, high temperatures prevail which are required for the course of the desired reactions and/or for a liquid slag withdrawal. As a rule it is necessary here to provide the walls of the hot reaction chambers with a respective temperature-resistant ceramic coating. This coating which is normally formed as a ramming or spraying mass is applied on the walls of the hot reaction chambers and serves for protecting these walls from damage by the action of the high temperature and at the same time for providing the required heat insulation in the hot reaction chamber so as to reliably maintain the desired high reaction temperatures inside the chamber. The walls of the hot reaction chambers can be naturally so-called tubular walls, when for example the hot reaction chamber is a melting chamber of a vaporizer or a reaction chamber of a coal pressure gasifier. For holding and/or cooling the ceramic coating, the walls of the hot reaction chamber are normally provided with pins on which the ceramic coating is mounted. Approximately 2000 pins are used per square meter of the coating.

The pin described in the above-mentioned patent application serves this purpose and is sufficient in the sense that, on the one hand, it has a high temperature-, corrosion-, erosion- and oxidation-resistance and, on the other hand, can be welded in a lasting manner to the wall of the hot reaction chamber without inflicting a damage to the wall material. Moreover, this pin can be produced in a relatively simple and cost-economical manner. For the connection of the pin shaft with the pin cap, various processes are proposed in the above-mentioned patent application, namely shrinking-on, resistance welding, screwing and cementing.

SUMMARY OF THE INVENTION

Accordingly, it is an object of the present invention to provide a pin of the above-mentioned type and a method of manufacturing the same, which is a further improvement of the pin and the manufacturing method of the invention disclosed in the parent application.

More particularly, it is an object of the present invention to provide a pin of the above-mentioned type and a method of manufacturing the same, in accordance with which the connection of the pin shaft and the pin cap is further improved in the sense of its strength and heat conductivity.

In keeping with these objects and with others which will become apparent herein after, one feature of the present invention resides, briefly stated, in a pin for holding and/or cooling of ceramic coatings in hot reaction chambers, in which a pin shaft is connected with a pin cap by a diffusion welding.

It is also an object of the present invention to provide a method of manufacturing the pin in accordance with which a pin shaft is produced, then a pin cap is produced, and then the pin shaft and the pin cap are connected with one another by a diffusion welding.

The novel features of the present invention which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The single figure of the drawing is a view showing a pin for holding and/or cooling of ceramic coatings in hot reaction chambers, in accordance with the present invention.

DESCRIPTION OF A PREFERRED EMBODIMENT

A pin for holding and/or cooling of ceramic coating in hot reaction chambers includes a pin shaft which is identified with reference numeral 1 and a pin cap which is identified with reference numeral 2. The pin shaft and the pin cap are connected with one another by a diffusion welding in a firm and heat-conductive manner. As a result of this a homogeneous material connection is produced, as identified with reference numeral 3.

More particularly, the pin shaft 1 is first inserted into the pin cap 2, and then the pin shaft and the pin cap are connected with one another by a round seam, for example by electrical welding. The welded pin is then placed into a so-called diffusion furnace which is heated to a temperature of approximately 700°–1100° C. After this, a pressure loading of the diffusion furnace takes place to a pressure of approximately 3000 bar. Under the action of the high temperature and high pressure a diffusion of the materials of the pin shaft and the pin cap takes place. As a result of this, the thus produced welding seam provides after cooling an extremely stable and heat-conductive connection of the pin shaft and pin cap.

The thus produced pin is connected by a welding seam 5 to a wall of a hot reaction chamber, on which a ceramic coating 6 is mounted. The ceramic coating 6 is in a continuous contact with the wall 4. A plurality of the pins mounted on the wall 4 provide a required hold of the ceramic coating 6.

The pin shaft 1 is composed of a material which under the conditions in the hot reaction chamber is temperature-, corrosion-, erosion- and oxidation-resistant, for example of chromium-aluminum steel. The pin cap 2 is composed, however, of a material which corresponds to the material of the wall 4 of the hot reaction chamber, or in other words of the material of the same type. Therefore during welding of the pin cap 2 and the wall 4 there are no embrittling problems and no damage to the wall material can take place.

In the pin in accordance with the present invention it is possible, by a respective material combination for the pin shaft and the pin cap 2 to adjust the structure of the pin completely to the predetermined process conditions in the hot reaction chamber.

The homogeneous material connection 3 which is produced by interdiffusion of the material of the pin shaft 1 and of the material of the pin cap 2 not only firmly connects these two parts with one another, but also provides for extremely high heat conduction between these two parts which is highly advantageous for the specific operation of the pin.

It will be understood that each of the elements described above, or two or more together, may also find a useful application in other types of constructions differing from the types described above.

While the invention has been illustrated and described as embodied in a pin for holding and/or cooling of ceramic coating in hot reaction chambers, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A pin for holding and/or cooling of a ceramic coating in hot reaction chambers, comprising a pin shaft composed of a material which is temperature-, corrosion-, erosion- and oxidation-resistant in reaction conditions in a hot reaction chamber; a pin cap composed of a material corresponding to the material of a wall of the hot reaction chamber; and means for connecting said pin shaft with said pin cap, said connecting means including a diffusion-welding produced seam interconnecting said pin shaft with said pin cap and forming therebetween a homogeneous material connection layer.

2. A method of manufacturing a pin for holding and/or cooling of a ceramic coating in hot reaction chambers, comprising the steps of providing a pin shaft composed of a material which is temperature-, corrosion-, erosion- and oxidation resistant in reaction conditions in a hot reaction chamber; providing a pin cap composed of a material corresponding to the material of a wall of the hot reaction chamber; and connecting said pin shaft with said pin cap by a diffusion welding with interdiffusion of the material of the pin shaft and the material of the pin cap so as to form therebetween a homogeneous material connection layer.

* * * * *